US006864856B2

(12) United States Patent
Lynch et al.

(10) Patent No.: US 6,864,856 B2
(45) Date of Patent: Mar. 8, 2005

(54) LOW PROFILE, DUAL POLARIZED/ PATTERN ANTENNA

(75) Inventors: Jonathan J. Lynch, Oxnard, CA (US); Joseph S. Colburn, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 40 days.

(21) Appl. No.: 10/459,117

(22) Filed: Jun. 10, 2003

(65) Prior Publication Data

US 2004/0027308 A1 Feb. 12, 2004

Related U.S. Application Data

(60) Provisional application No. 60/388,097, filed on Jun. 10, 2002.

(51) Int. Cl.[7] ..... H01Q 1/36
(52) U.S. Cl. ..... 343/895; 343/853
(58) Field of Search ..... 343/895, 700 MS, 343/850, 853, 846

(56) References Cited

U.S. PATENT DOCUMENTS

| | | | | |
|---|---|---|---|---|
| 3,019,439 A | | 1/1962 | Reis et al. | 343/853 |
| 3,137,002 A | | 6/1964 | Kaiser, Jr. et al. | 343/854 |
| 3,820,117 A | * | 6/1974 | Hall et al. | 343/802 |
| 3,838,429 A | | 9/1974 | Reggia | 343/750 |
| 3,925,784 A | * | 12/1975 | Phelan | 343/754 |
| 4,032,921 A | * | 6/1977 | Sikina et al. | 343/730 |
| 4,051,477 A | | 9/1977 | Murphy et al. | 343/700 MS |
| 4,605,934 A | | 8/1986 | Andrews | 343/895 |
| 5,313,216 A | | 5/1994 | Wang et al. | 343/700 MS |
| 6,433,756 B1 | | 8/2002 | Sievenpiper et al. | 343/909 |
| 6,545,647 B1 | | 4/2003 | Sievenpiper et al. | 343/795 |
| 6,646,618 B2 | | 11/2003 | Sievenpiper | 343/770 |

FOREIGN PATENT DOCUMENTS

| | | |
|---|---|---|
| EP | 0 957 533 A1 | 11/1999 |
| GB | 2 251 981 A | 7/1992 |

OTHER PUBLICATIONS

Balanis, C.A., *Antenna Theory Analysis and Design*, 2nd Edition, Pub. John Wiley & Sons, New York, pp. 416–421 (1997).

Corzine, et al., *Four–Arm Spiral Antenna*, Norwood, MA, Pub. Artech House, pp. 5–78 (1990).

Nakano, H., et al., "A Spiral Antenna Backed by a Conducting Plane Reflector," *IEEE Transactions on Antennas and Propagation*, vol. AP–34, No. 6, pp. 791–796 (Jun. 1986).

Wang, J.J.H., et al., "Design of Multioctave Spiral–Mode Microstrip Antennas," *IEEE Transactions on Antennas and Propagation*, vol. 39, No. 3, pp. 332–335 (Mar. 1991).

* cited by examiner

*Primary Examiner*—Hoang V. Nguyen
(74) *Attorney, Agent, or Firm*—Ladas & Parry LLP

(57) ABSTRACT

A spiral antenna system optimized to transmit and/or receive linearly polarized signals and circularly polarized signals. The antenna system includes a spiral antenna and a circuit for exciting the spiral antenna to transmit or receive linearly polarized and circularly polarized signals simultaneously.

31 Claims, 4 Drawing Sheets

LOW PROFILE, DUAL POLARIZED/ PATTERN ANTENNA

CROSS REFERENCE TO RELATED APPLICATION

This application claims the benefits of U.S. Provisional Patent Application 60/388,097 filed Jun. 10, 2002, the disclosure of which is hereby incorporated hereby by this reference.

FIELD OF THE INVENTION

The present invention relates to antenna systems which may be used on vehicles to communicate with both a satellite and a terrestrial system.

BACKGROUND OF THE INVENTION

There is currently a need for antennas and/or antenna systems that can communicate with both a satellite and a terrestrial system. One example of such a need is for a Direct Broadcast Satellite (DBS) radio in which radio signals are broadcasted from a satellite and are received by a receiver located on the vehicle and are also received by terrestrial repeaters which rebroadcast the signals therefrom to the same vehicle. Typically, a DBS uses circular polarization so the vehicle can receive the transmission in any orientation. However, terrestrial networks typically transmit in linear, vertical polarization. If satellite communication fails (e.g., if the satellite becomes hidden by a building or by another object, man-made or natural), then the terrestrially rebroadcast signal can be used to fill in the gaps in the satellite signal.

DBS radio systems typically have a narrow bandwidth (about 0.5%) due to the low power available from satellites, as well as the problems associated with mobile wireless communications.

On the other hand, an antenna is typically designed with at least several percent bandwidth to account for possible errors in manufacturing. For this reason, the antennas used to receive DBS radio signals will generally have a much wider bandwidth than the signals of interest (both satellite and terrestrial), and thus the various components of DBS signals can be considered as being essentially at the same frequency.

There is a need for antennas or antenna systems that can receive radio frequency signals having circular polarization and/or linear vertical polarization. Furthermore, the antenna or antenna system should preferably be able to utilize different radiation patterns for each of these two functions. The antenna or antenna system should have a radiation pattern lobe with circular polarization directed towards the sky at the required elevation angle for satellite reception, and also have a radiation pattern lobe with linear polarization directed towards the horizon for terrestrial repeater reception.

Currently, there are antennas that can perform these two functions. One example of such an antenna is the quadrafilar helix antenna, which consists of four wires wound in a helical geometry. The drawback of this antenna is that it typically protrudes more than one-half wavelength from the surface of wherever it is mounted and, thus, if it is mounted on the exterior surface of a vehicle, it results in an unsightly and unaerodynamic vertical structure.

The antenna disclosed herein performs these two functions yet protrudes less than one-quarter wavelength from the roof of the vehicle. It is able to perform as a dual circular/linear polarized antenna with optimized antenna patterns for both the satellite and terrestrial links.

This invention offers a method of operating a spiral antenna simultaneously as a top-loaded monopole and in second resonance spiral mode.

The prior art includes:

(1) U.S. Pat. No. 5,313,216, "Multioctave Microstrip Antenna," by Wang, et al. and assigned to Georgia Tech Research Corporation. This patent describes a microstrip antenna that is between $0.02\lambda_c$ and $0.1\lambda_c$, where $\lambda_c$ is the wavelength at the geometric mean between the minimum and maximum operating frequencies above the ground plane. While this patent describes a spiral antenna mounted above the ground plane, it does not suggest dual mode operation or operation of the spiral as a top-loaded monopole.

(2) U.S. Pat. No. 4,051,477, "Wide Beam Microstrip Radiator," L. R. Murphy, G. G. Sanford, and assigned to Ball Brothers Research Corporation. This patent describes a method of improving the low-angle radiation from an antenna by raising it above the ground plane on a pedestal.

(3) Nakano, et.al, "A Spiral Antenna Backed by a Conducting Plane Reflector," IEEE Transactions on Antennas and Propagation, vol. 34, no. 6, pp. 791–796, June 1986.

(4) Wang, et.al, "Design of Multioctave Spiral-Mode Microstrip Antennas," IEEE Transactions on Antennas and Propagation, vol. 39, no. 3, pp. 332–335, March 1991. This article provides more measured results for the spiral antenna configuration described in U.S. Pat. No. 5,313,216.

(5) Corzine, et.al, *Four-Arm Spiral Antennas*; Norwood, Mass.; Artech House; 1990. This book covers many aspects of four arm spiral antennas. The book documents many of the first advances in spiral antennas and feed networks.

(6) C. Balams, *Antenna Theory Analysis and Design,* $2^{nd}$ edition, John Wiley and Sons, New York, 1997.

Related art includes the following patent applications which are assigned to assignee of the present invention:

(1) D. F. Sievenpiper; H. P. Hsu; J. H. Schaffner; G. L. Tangonan, "An Antenna System for Communicating Simultaneously with a Satellite and a Terrestrial System," U.S. patent application Ser. No. 09/905,795 filed Jul. 13, 2001, the disclosure of which is hereby incorporated herein by reference. An antenna system on a Hi-Z surface able to receive vertically and circularly polarized RF signals is disclosed by this application.

(2) D. F. Sievenpiper; J. H. Schaffner; H. P. Hsu; G. L. Tangonan, "A Method for Providing Increased Low-Angle Radiation in an Antenna," U.S. patent application Ser. No. 09/905,796 filed Jul. 13, 2001, the disclosure of which is hereby incorporated herein by reference. A crossed slot antenna able to receive vertically and circularly polarized RF signals is disclosed by this application.

(3) D. F. Sievenpiper, "A Low-Profile Slot Antenna for Vehicular Communications and Methods of making and Designing Same," U.S. patent application Ser. No. 09/829,192 filed Apr. 10, 2001, the disclosure of which is hereby incorporated herein by reference. A low-profile slot antenna able to receive vertically and circularly polarized RF signals is disclosed by this application.

SUMMARY OF THE INVENTION

In one aspect, this invention utilizes a spiral antenna to provide efficient radiation and/or reception of circularly polarized signals in a direction approximately 30 to 70 degrees from the axis of the spiral and, simultaneously, linearly polarized signals in a direction closer to the plane of the spiral. In the preferred embodiment, the spiral antenna provides efficient radiation and/or reception of circularly polarized signals in a direction approximately 45 degrees from the axis of the spiral. Simultaneous reception of both circularly and linearly polarized signals is achieved by exciting the spiral antenna in two ways. A feed network is preferably utilized which has two outputs that are routed to a radio transmitter and/or a radio receiver. A transceiver could be used if the antenna system is used for both receiving and transmitting signals. The primary advantage of this antenna system is that the antenna patterns may be optimized for receiving simultaneous terrestrial and satellite links while preferably still maintaining a low profile (for example, a height less than a quarter wavelength).

In another aspect, the invention provides an antenna system comprising: a spiral antenna having a plurality of arms; a ground plane located a distance from the spiral antenna; and a feed network located on the ground plane, the feed network coupled to the spiral antenna, wherein the feed network excites the spiral antenna to generate linearly polarized signals and circularly polarized signals.

In yet another aspect, the invention provides a spiral antenna system comprising: a spiral antenna; a method for exciting the spiral antenna for providing simultaneous circular and linear polarizations where linearly polarized signals are transmitted toward or received from a direction of the horizon and circularly polarized signals are transmitted toward or received from a direction 30 to 70 degrees above the horizon; and a method of supporting the spiral antenna above a ground plane containing the method for exciting the spiral antenna.

Yet another aspect of the present invention provides a method for transmitting/receiving linearly polarized signals and circularly polarized signals within a band of interest, the method comprising the steps of: providing a spiral antenna with a plurality of arms, where n equals the number of arms in the plurality of arms; exciting the plurality of arms whereby adjacent arms have a phase shift of 720/n degrees between them for transmission and/or reception of circularly polarized signals; supporting the spiral antenna at a distance above a ground plane; and exciting a pair of conductors with respect to the ground plane and in phase with each other for transmission/reception of linearly polarized signals.

Yet another aspect of the present invention provides a spiral antenna system operating in both a top-loaded monopole mode and a second resonance spiral mode, where the top-loaded monopole mode is for receiving linearly polarized signals and the second resonance spiral mode is for receiving circularly polarized signals, the spiral antenna system operating within a band of interest, the antenna system comprising: a spiral antenna having four arms; a support for supporting the spiral antenna at a distance above a ground plane; a microstrip circuit connected to the spiral antenna, the microstrip circuit exciting the spiral antenna; and a pair of conductors, having a first end and a second end, the first end coupled to the spiral antenna, and the second end coupled to the microstrip circuit.

Yet another aspect of the present invention provides an antenna system operating within a band of interest, the antenna system comprising: a spiral antenna having a plurality of arms; a support for supporting the spiral antenna at a distance above a ground plane, the distance optimizing an elevation angle of peak radiation; a microstrip circuit connected to the spiral antenna, the microstrip circuit exciting the spiral antenna; and a plurality of resistors, at least one resistor disposed on one of the plurality of arms of the spiral antenna.

Yet another aspect of the present invention provides a method for providing a low profile antenna system comprising the steps of: providing a spiral antenna, having at least one pair of arms; supporting the spiral antenna at a distance above a ground plane, the distance preferably optimizing an elevation angle of peak radiation; connecting the spiral antenna to a feed cable, the feed cable having an outer conductor; and exciting the outer conductor of the feed cable with respect to ground to yield a monopole.

DETAILED DESCRIPTION OF THE PREFERRED EMBODIMENT

Figure 1:
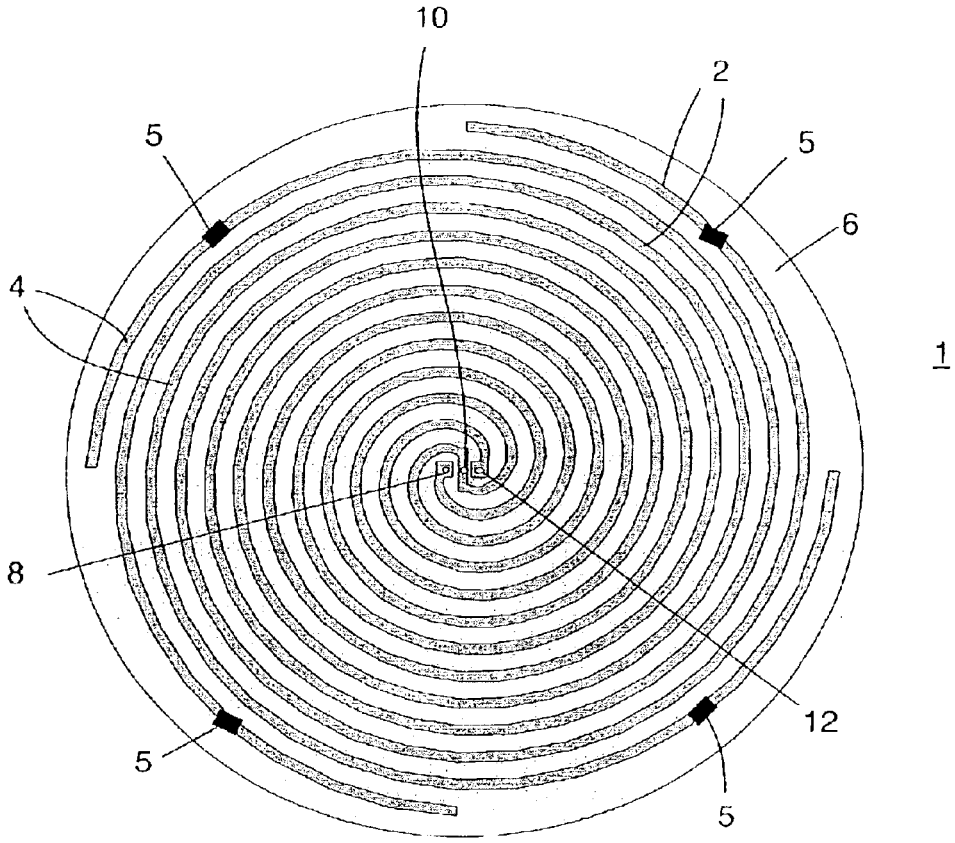
FIG. 1 depicts the radiating side of the presently disclosed spiral antenna system.

In accordance with the present invention, a spiral antenna 1 (see FIG. 1) may be operated in one of three different modes. These modes are generated by exciting the arms of the spiral with a phase shift between adjacent arms that is based the total number of arms, n, in the spiral. In one embodiment (mode 1), a 360/n degree phase shift is applied between adjacent arms. In another embodiment (mode 2), a 720/n degree phase shift is applied between adjacent arms, and for a third embodiment (mode 3), a 1080/n degree phase shift is applied between adjacent arms. Each of these embodiments (modes in this case) generates a different radiation pattern. In a preferred embodiment, the spiral antenna is operated in mode 2 and the spiral is optimized for use in a DBS system such as the XM Satellite Radio system, which uses a frequency band of 2.3325 GHz to 2.345 GHz. In mode 2, where the spiral antenna has 4 arms (n=4), the phase shift is equal to 720/4 or 180 degrees.

FIG. 1 is a depiction of the radiating side of the spiral antenna 1. The spiral antenna 1 comprises a plurality of pairs of arms 2, 4 that are preferably disposed on a substrate 6 mounted above a ground plane 14 (see FIG. 2*a* for example). The substrate 6 may be, for example, 60 mils (1.5 mm) thick having a 17 $\mu$m thick copper cladding disposed thereon that is etched using conventional techniques to form the pairs of arms 2, 4. A suitable cladded substrate material is sold by Rogers Corporation of Chandler, Ariz. as part number RO3003. The plurality of pairs of arms 2, 4 are preferably formed by etching the copper on one side of the substrate 6. In this embodiment, the spiral antenna has two pairs of arms 2, 4. The ground plane 14 is preferably embodied as a metallic layer of a cladded dielectric substrate. Both the substrate 6 and the ground plane 14 are preferably planar.

Figure 2A:
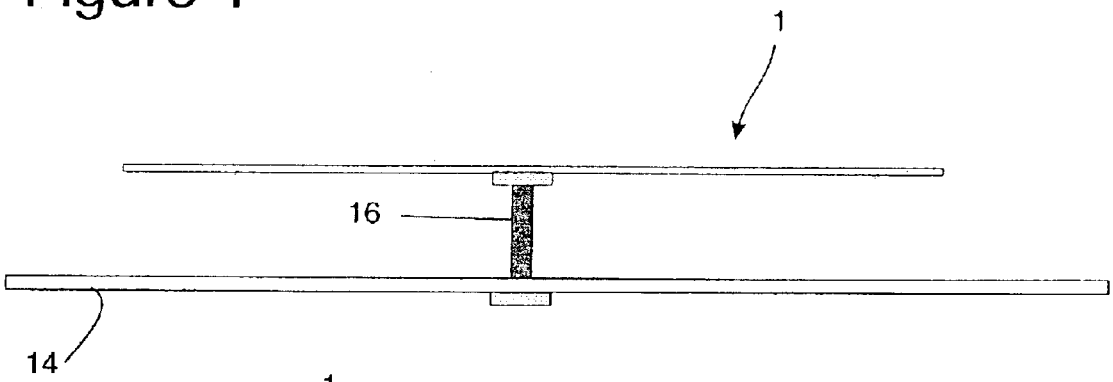
FIG. 2*a* shows one embodiment of the system depicting the location of the spiral antenna relative to the ground plane and a coaxial cable connecting the feed circuit located on the bottom of the ground plane to the spiral antenna.

For this embodiment, the spiral antenna 1 is preferably mounted about approximately one inch (2.54 cm) above the ground plane 14, as shown in FIG. 2*a*. One inch (2.54 cm) was chosen to optimize the elevation angle of the peak radiation when the spiral antenna 1 of this embodiment is operating in mode 2 in the frequency band of 2.3325 GHz to 2.345 GHz. One inch (2.54 cm) places the spiral antenna 1 about $0.2\lambda_c$ above the ground plane 14. $\lambda_c$ is the wavelength at the geometric mean between the minimum and maximum operating frequencies of the spiral antenna.

To aid in assembly of the antenna, the etched side of the spiral antenna 1 is preferably mounted facing the ground plane 14. However, the etched side of the spiral antenna 1 may also be mounted facing away from the ground plane 14, if desired.

Figure 3:
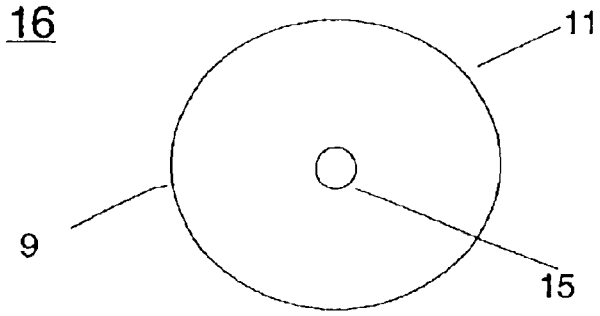
FIG. 3 depicts a cross sectional view of a coaxial cable.

As depicted in FIG. 2*a*, a coaxial cable 16 is attached to the spiral antenna 1. The coaxial cable 16 is just one example of many methods known in the art to pass the signals to and from an antenna. There are two signals to be passed to and from the spiral antenna 1, one signal from each of the pair of arms 2, 4. For the purpose of clarity, one manner for connecting the spiral antenna 1 to the coaxial cable 16 is described herein. However, given the symmetry of the spiral antenna, either pair of arms 2, 4 may be connected to either the center conductor 15 or to the outer conductor 9, 11 (see FIG. 3) of the coaxial cable 16.

As shown in FIG. 1, the spiral antenna 1 preferably includes a via 10 for the connection of the center conductor 15 of the coaxial cable 16 to the first pair of arms 2. In addition, the spiral antenna 1 preferably has two additional vias 8, 12 for the connection of the outer conductor 9, 11 of the coaxial cable 16 to the second pair of arms 4. The spiral is preferably fed by a 50 ohm coaxial cable 16, providing an input impedance match of $|S11|<-10$ dB, therefore an impedance matching circuit is not provided. However, one skilled in the art may choose to implement and provide matching circuit depending on the method chosen to pass the signals to and from the spiral antenna 1. Other connection methods well known in the art may be used for connecting spiral antenna 1 with coaxial cable 16. For example, if the spiral antenna 1 is located on a lower side of the substrate 6, then the coaxial cable 16 can be soldered directly to the spiral antenna 1 without the use of any vias.

Figure 4A:
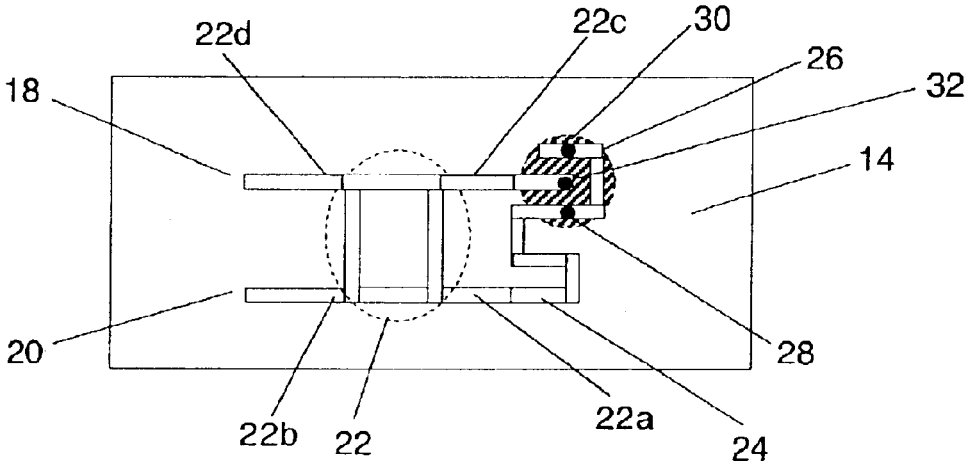
FIG. 4*a* depicts one embodiment for exciting the adjacent arms of the spiral antenna.

As shown in FIG. 2*a*, the opposite end of the coaxial cable 16 is attached to a feed network (see FIG. 4*a*). In one embodiment, the feed network is disposed on the ground plane 14 on the side furthest away from the spiral antenna 1. The purpose of the feed network is to excite the spiral antenna 1 to transmit and/or receive linearly and circularly polarized signals. For circular polarization the spiral antenna 1 is operated in mode 2 discussed above by exciting one pair of arms 2 in one phase and the other pair of arms 4 in another phase, wherein the difference between the two phases is preferably 180 degrees for the two pairs of arms. For linear polarization the spiral antenna 1 is operated as a top-loaded monopole using the outer conductor 9, 11 of the coaxial cable 16 as a monopole. The spiral antenna 1 mounted at the end of the coaxial cable 16 loads the monopole.

Linearly polarized signals are generated, using the top-loaded monopole on the coaxial cable 16, by exciting, with respect to the ground plane 14, both the inner 15 and outer conductors 9, 11 of the feed coaxial cable in phase with respect to each other. The length of the coaxial cable 16 is chosen such that one of the resonances of the coaxial cable 16, as loaded by the spiral antenna arms 2, 4, lines up with a frequency of interest, for example, a center frequency of about 2.339 GHz in the frequency band of 2.3325 GHz to 2.345 GHz. As indicated above, the spiral antenna 1 is located about $0.2\lambda_c$ above the ground plane 14 and therefor the length of coaxial cable 16 is likewise $0.2\lambda_c$, which is means the monopole formed by the coaxial cable 16 has a height less than one quarter wavelength above the ground plane 14 due to the top loading provided by the arms 2, 4.

As shown in FIG. 4*a*, an opening 26 in ground plane 14 is provided, exposing its dielectric substrate, which substrate is utilized to isolate coaxial connection vias 28, 30, 32 from the ground plane 14. Thus, a potential may be applied to the coaxial shield conductor 9, 11 with respect to the feed circuit ground plane 14. The radiation pattern generated by the top-loaded monopole is vertically polarized with a peak in the radiation pattern near the horizon (with an assumption of an infinite ground plane).

FIG. 4*a* depicts one embodiment for the aforementioned feed network. In FIG. 4*a*, a microstrip circuit is depicted comprising a 90 degree hybrid coupler 22 coupled to an additional quarter wavelength transmission line 24. The inner conductor 15 of the coaxial cable 16 is connected through a via 32 in the substrate of the feed network. One portion 11 of the outer shield conductor of the coaxial cable 16 is connected through a via 28 in the substrate, while another portion 9 of the outer shield conductor of the coaxial cable 16 is connected through via 30 in the substrate. Via 30 and via 28 are electrically coupled together through a transmission line to the quarter wavelength transmission line 24. Another transmission line connects the quarter wavelength transmission line 24 to a first port 22*a* of the 90 degree hybrid coupler 22. An example of a 90 degree hybrid coupler 22 that may be utilized is a 2 to 4 GHz 90 degree hybrid coupler made by Anaren of East Syracuse, N.Y. as part No. 10016-3. Another transmission line provides a path from a second port 22*b* of the 90 degree hybrid coupler 22 to the feed side lower port 20 of the circuit. Via 32 is connected through a transmission line to a third port 22*c* of the 90 degree hybrid coupler 22. Another transmission line provides a path from a fourth port 22*d* of the 90 degree hybrid coupler 22 to the feed side upper port 18 of the circuit.

When the feed side upper port 18 of the feed network shown in FIG. 4*a* is excited, the inner conductor 15 and outer shield conductor 9, 11 of the coaxial cable 16 will be excited 180 degrees out of phase and hence mode 2 of the spiral will be generated. On the other hand, when the feed side lower port 20 of the feed network shown in FIG. 4*a* is excited, both the inner 15 and outer conductor 9, 11 of the coaxial cable 16 will be excited with respect to the ground plane 14 in phase with respect to each other, hence a monopole mode will be generated. Thus, with this feed network, the spiral antenna can be excited to operate in mode 2 and as a top-loaded monopole simultaneously. Those skilled in the art will appreciate that additional circuitry can be added between the feed side ports 18, 20 and the 90 degree hybrid coupler 22, e.g., low noise amplifiers.

When the spiral antenna is operated in mode 2, the lowest frequency response occurs when the outer radius of the spiral is approximately two wavelengths in circumference. In one embodiment, the spiral is optimized for use in the XM Satellite Radio system, which uses a frequency band of 2.3325 GHz to 2.345 GHz. Thus, the optimum diameter of the spiral is approximately 4 inches (10 cm). The spiral can be made smaller using materials in the direct vicinity of the spiral that have higher dielectric constants.

For improved axial ratio performance (a measure of the circular polarization purity) of spiral antennas, a common practice in the art is to absorb the energy that is not radiated but reaches the ends of the spiral arms to avoid the non-radiated energy reflecting from the open circuited ends of the arms. The absorption of energy is commonly done by placing microwave absorbing material around the perimeter of the spiral, suppressing the unwanted cross polarization over a wide bandwidth. However, the presence of the absorber around the perimeter in the antenna will also absorb energy radiated by the top-loaded monopole. To overcome this problem, one may place chip resistors 5, as shown in FIG. 1, in each arm of the spiral a quarter wavelength (at the center frequency of the band of interest) from the end of each of the arms 2, 4. The quarter wavelength location results in a series resistance to a virtual ground produced by the open circuited spiral end and is easy to implement in volume production. In one embodiment, a 200 ohm chip resistor 5 was placed 1.25 inches (3.175 cm) from the end of each spiral.

Figure 5:
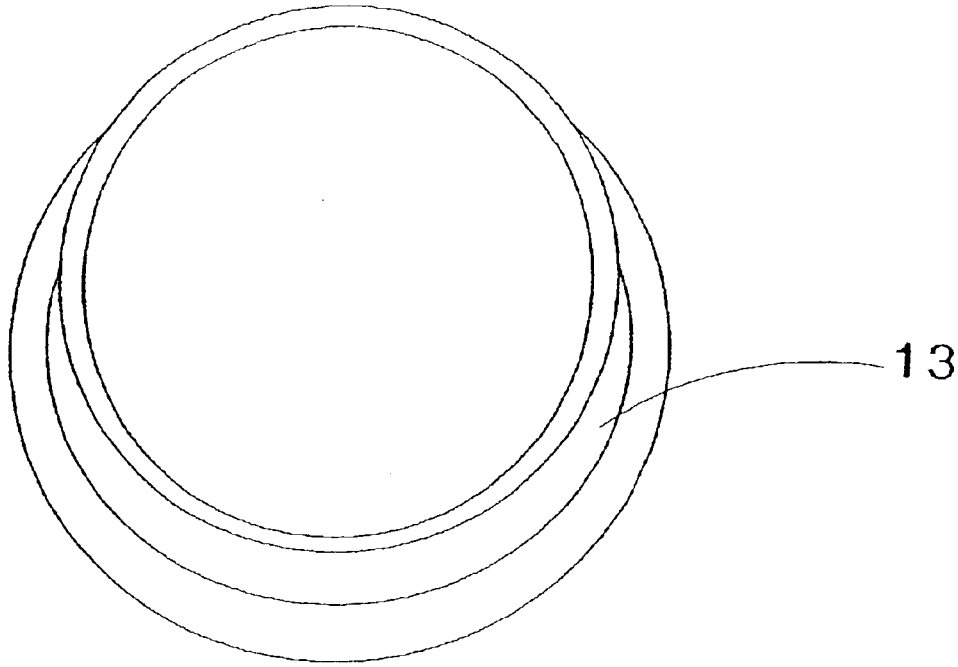
FIG. 5 shows the top view of an embodiment of a radome over the spiral antenna mounted on a ground plane.
Figure 6:
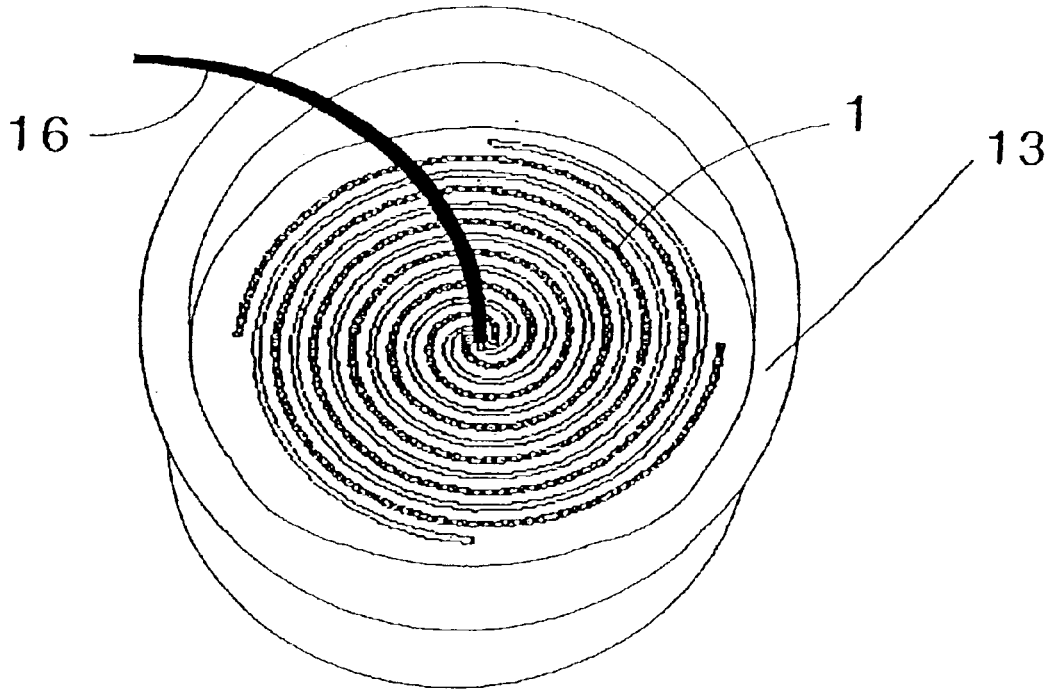
FIG. 6 shows the bottom view of an embodiment of a radome with the spiral antenna mounted inside.

One means for mounting the spiral antenna to protect it from the environment and to provide a distance between the spiral antenna 1 and the ground plane 16 is to use a dielectric cover 13, such as a polycarbonate, as a radome as shown in FIG. 5. FIG. 6 depicts the spiral antenna mounted inside the radome cover 13 (but without the ground plane 14 in place).

Figure 7:
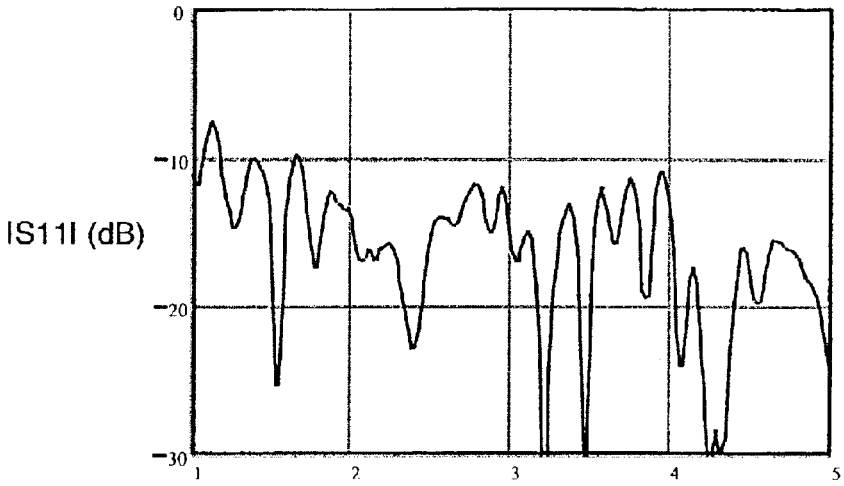
FIG. 7 is a plot of the measured input reflection coefficient of the fabricated spiral antenna producing the second resonance spiral pattern.
Figure 8A:
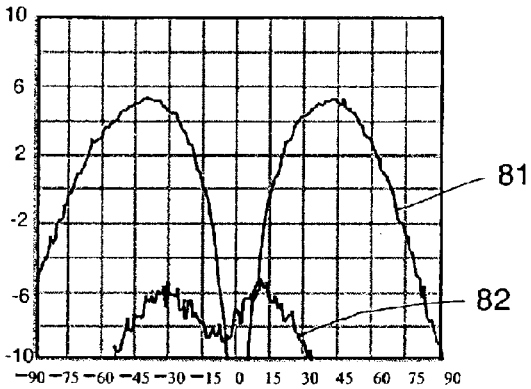
FIG. 8*a* is a plot of the measured radiation pattern.
Figure 8B:
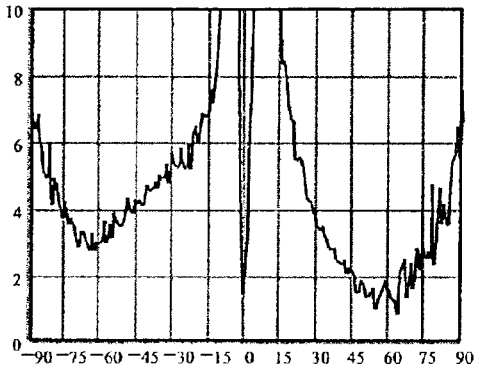
FIG. 8*b* is a plot of the measured axial ratio performance of the fabricated spiral antenna producing the second resonance spiral pattern.

FIG. 7 is a plot of the measure of input match of the spiral antenna fabricated using the dimensions described above operating in mode 2. FIG. 8*a* is a plot of the measure radiation pattern and FIG. 8*b* is a plot of the antenna's axial ratio performance at 2.34 GHz. As shown in FIG. 8*a*, the co-pol energy 81 is significantly higher than the cross-pol energy 82. The data shown in these plots indicate the spiral antenna 1 operates well in mode 2 in the frequency band of interest for a DBS system such as the XM Satellite Radio system.

Figure 9:
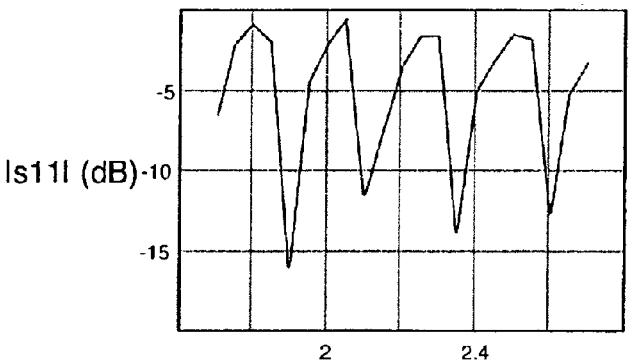
FIG. 9 is a plot of the simulated input reflection coefficient of the spiral antenna operating as a top-loaded monopole

Full wave simulations of the structure operating as a top-loaded monopole have been made using Ansoft's HFSS software. In these simulations, the spiral was above an infinite ground plane and the chip resistors in each arm of the spiral were not included. FIG. 9 is a plot of the computed input match of the top-loaded monopole mode. In the frequency band of interest, the computed input match was less than 10 dB, and the radiation pattern was similar to a monopole above an infinite ground plane.

Figure 2B:
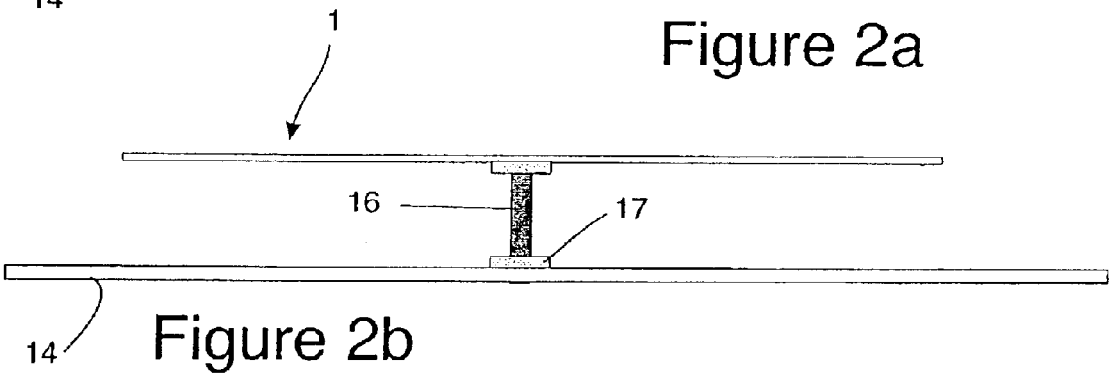
FIG. 2*b* shows another embodiment of the system depicting the feed circuit located on the top of the ground plane.

In another embodiment as shown in FIG. 2*b*, the feed network is disposed on the ground plane 14 on the side closest to the spiral antenna 1. In this embodiment, the feed network is enclosed in a small conductive enclosure 17, thereby not interfering with the interaction between the spiral antenna 1 and the ground plane 14. If the feed network is disposed on the ground plane 14 closer to the spiral antenna 1, then there would be no need for the aperture 26 in the ground plane 14 or for the vias 28, 30 and 32 in the ground plane 14. As indicated above, coaxial cable 16 can be directly attached to (i) the spiral arm traces on the spiral antenna 1, when they are disposed on a lower surface of substrate 6, and to (ii) the feed network traces in the feed network which is then also preferably mounted on substrate 6, thereby obviating any need for any vias 8, 10, 12 in the spiral antenna.

Figure 4B:
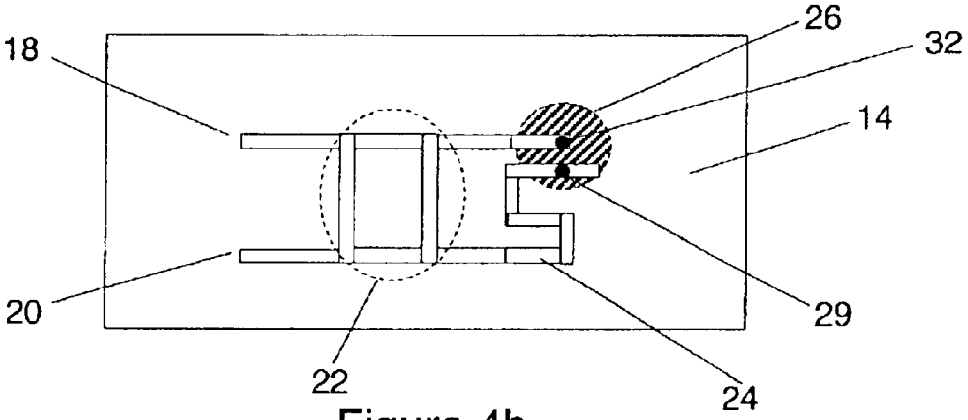
FIG. 4*b* depicts a second embodiment for exciting the adjacent arms of the spiral antenna.

Another embodiment of the feed network is depicted in FIG. 4*b*. In FIG. 4*b*, vias 28 and 30 are replaced by a single via 29. The outer conductor 11 of the coaxial cable 16 is connected through via 29 in the substrate. Via 29 is connected to a quarter wavelength transmission line 24. The remainder of the circuit is connected as described above for FIG. 4*a*.

Although the invention has been described in conjunction with one or more embodiments, it will be apparent to those skilled in the art that other alternatives, variations and modifications will be apparent in light of the foregoing description. Thus, the invention described herein is intended to embrace all such alternatives, variations and modifications that are within the scope of the following claims.

What is claimed is:

1. A method of transmitting and/or receiving linearly polarized signals and circularly polarized signals within a frequency band, the method comprising:

providing a spiral antenna with a plurality of arms, where n equals the number of arms in said plurality of arms;

exciting said plurality of arms whereby adjacent arms have a phase shift of 720/n degrees between them for transmission and/or reception of circularly polarized signals;

supporting said spiral antenna at a distance above a ground plane; and exciting a pair of conductors with respect to said ground plane and in phase with each other for transmission and/or reception of linearly polarized signals.

2. The method of claim 1 wherein a feed coaxial cable comprises said pair of conductors.

3. The method of claim 1 wherein said step of exciting said plurality of arms and said step of exciting a pair of conductors occurs independently or simultaneously.

4. The method of claim 1 wherein n equals 4.

5. The method of claim 1 further comprising the step of placing at least one resistor on at least one of said plurality of arms.

6. The method of claim 5 wherein the step of placing further comprises locating the at least one resistor at a distance of a quarter wavelength of a center frequency of said frequency band from an end of the at least one of said plurality of arms.

7. The method of claim 1 wherein the step of providing a spiral antenna with a plurality of arms includes disposing said spiral antenna with said plurality of arms on a planar surface.

8. The method of claim 1 wherein the step of providing a spiral antenna with a plurality of arms includes disposing said spiral antenna with said plurality of arms in a planar configuration.

9. The method of claim 7 wherein said linearly polarized signals are transmitted toward or received from a direction at or near a horizon and said circularly polarized signals are transmitted toward or received from a direction 30 to 70 degrees above the plane of said plurality of arms.

10. The method of claim 1 wherein said step of supporting further comprises the step of choosing said distance to optimize an elevation angle of peak radiation.

11. The method of claim 10 wherein said distance is at least $0.2\lambda_c$, wherein $\lambda_c$ is a wavelength at a geometric mean between a minimum and a maximum operating frequency of the spiral antenna.

12. An antenna system comprising:

a spiral antenna having a plurality of arms;

a ground plane located a distance from said spiral antenna; and a feed network located on said ground plane, said feed network coupled with said spiral antenna, wherein said feed network excites said spiral antenna to generate linearly polarized signals and circularly polarized signals.

13. The antenna system of claim 12 wherein said spiral antenna has four arms.

14. The antenna system of claim 12 further comprising a coaxial cable coupled with said spiral antenna and said feed network.

15. The antenna system of claim 12 further comprising a plurality of resistors, each resistor disposed on one of said plurality of arms of said spiral antenna.

16. The antenna system of claim 12 wherein said distance optimizes an elevation angle of peak radiation.

17. The antenna system of claim 16 wherein said distance is at least $0.2\lambda_c$, wherein $\lambda_c$ is a wavelength at a geometric mean between a minimum and a maximum operating frequency of the spiral antenna.

18. The antenna system of claim 12 wherein said spiral antenna including the plurality of arms are disposed in a planar configuration.

19. A spiral antenna system operating within a band of interest, the antenna system comprising:

a spiral antenna having four arms;

a support for supporting said spiral antenna at a distance above a ground plane;

a microstrip circuit connected to said spiral antenna, said microstrip circuit exciting said spiral antenna;

a pair of conductors, having a first end and a second end, said first end coupled to said spiral antenna, said second end coupled to said microstrip circuit; and wherein said spiral antenna system operates in both a top-loaded monopole mode and a second resonance spiral mode, where the top-loaded monopole mode is for receiving linearly polarized signals and the second resonance spiral mode is for receiving circularly polarized signals.

20. The spiral antenna system of claim 19 further comprising a plurality of resistors, at least one resistor of said plurality of resistors being disposed on one of said four arms of said spiral antenna.

21. The spiral antenna system of claim 20 wherein said at least one resistor is disposed on one of said four arms of said spiral antenna at a distance of a quarter wavelength of a center frequency of the band of interest from an end of one of said four arms.

22. The spiral antenna system of claim 19 wherein said support for supporting said spiral antenna is a polycarbonate cover.

23. The spiral antenna system of claim 19 wherein said distance is at least $0.2\lambda_c$, wherein $\lambda_c$ is a wavelength at a geometric mean between a minimum and a maximum operating frequency of the spiral antenna.

24. The spiral antenna system of claim 19 wherein said microstrip circuit comprises:

a first via and a second via for connecting said microstrip circuit to said spiral antenna;

a quarter wavelength transmission line with a first end and a second end, said first end coupled to said second via; and a 90 degree hybrid coupler, having a first port, a second port, a third port and a fourth port, said first port of said 90 degree hybrid coupler coupled to said second end of said quarter wavelength transmission line, said second port of said 90 degree hybrid coupler coupled to said first via.

25. An antenna system operating within a band of interest, said antenna system comprising:

a spiral antenna having a plurality of arms;

a planar support substrate for supporting said spiral antenna at a distance above a ground plane, said distance optimizing an elevation angel of peak radiation;

a microstrip circuit connected to said spiral antenna, said microstrip circuit exciting said spiral antenna; and a plurality of resistors, at least one resistor disposed on one of said plurality of arms of said spiral antenna.

26. The antenna system of claim 25 further comprising a pair of conductors, having a first end and a second end, said first end coupled to said spiral antenna, said second end coupled to said microstrip circuit.

27. The antenna system of claim 25 wherein said distance is at least $0.2\lambda_c$, wherein $\lambda_c$ is a wavelength at a geometric mean between a minimum and a maximum operating frequency of the spiral antenna.

28. The antenna system of claim 25 wherein said at least one resistor is disposed on one of said four arms of said spiral antenna at a distance of a quarter wavelength of a center frequency of the band of interest from an end of one of said four arms.

29. A method for providing a low profile antenna system comprising the steps of:

providing a spiral antenna, having at least one pair of arms;

supporting said spiral antenna at a distance above a ground plane, said distance optimizing an elevation angle of peak radiation;

connecting said spiral antenna to a feed cable, said feed cable having an outer conductor; and exciting said outer conductor of said feed cable with respect to said ground to generate a monopole.

30. The method of claim 29 wherein said spiral antenna having at least two pairs of arms and further comprising the step of exciting said pairs of arms whereby adjacent arms have a 720/n degrees phase shift between them generating a second resonance spiral mode in said spiral.

31. The method of claim 29 wherein said distance is at least $0.2\lambda_c$, wherein $\lambda_c$ is a wavelength at a geometric mean between a minimum and a maximum operating frequency of the spiral antenna.

* * * * *